US006513309B1

(12) United States Patent
Morgante

(10) Patent No.: US 6,513,309 B1
(45) Date of Patent: Feb. 4, 2003

(54) STIRRUPS

(76) Inventor: Adrian Anthony Morgante, Suite 18, Main Beach Tower, 20 Cronin Avenue, Main Beach Queensland 4217 (AU)

( * ) Notice: Subject to any disclaimer, the term of this patent is extended or adjusted under 35 U.S.C. 154(b) by 307 days.

(21) Appl. No.: 10/048,183

(22) PCT Filed: Jul. 17, 2000

(86) PCT No.: PCT/AU00/00856

§ 371 (c)(1),
(2), (4) Date: Jan. 28, 2002

(87) PCT Pub. No.: WO01/09030

PCT Pub. Date: Feb. 8, 2001

(30) Foreign Application Priority Data

Jul. 29, 1999 (AU) ..... PQ 1899

(51) Int. Cl.[7] ..... B68C 3/00; G05G 1/14
(52) U.S. Cl. ..... 54/47; 54/49; 74/594.6
(58) Field of Search ..... 54/47, 49, 49.5; 74/594.4, 594.6; D30/142; D12/125

(56) References Cited

U.S. PATENT DOCUMENTS

| | | | | | |
|---|---|---|---|---|---|
| 267,728 | A | * | 11/1882 | Shellenberger | 54/49 |
| 800,862 | A | * | 10/1905 | Martin | 54/47 |
| 1,062,327 | A | * | 5/1913 | Erbe | 54/49 |
| D108,285 | S | * | 2/1938 | Hart | D30/142 |
| 4,200,005 | A | * | 4/1980 | Mohr | 74/594.6 |
| 4,856,211 | A | * | 8/1989 | Phillips | 74/594.6 |
| 5,390,478 | A | | 2/1995 | Holsworth | 54/49 |

FOREIGN PATENT DOCUMENTS

| | | |
|---|---|---|
| FR | 2607488 A | 2/1995 |
| GB | 2216384 A | 10/1989 |
| GB | 2274381 A | 7/1994 |
| GB | 1474192 A | 5/1997 |

* cited by examiner

*Primary Examiner*—Charles T. Jordan
*Assistant Examiner*—Elizabeth Shaw
(74) *Attorney, Agent, or Firm*—Quarles & Brady LLP

(57) ABSTRACT

An accessory (10) for a stirrup iron (12) having a stirrup bottom (14) and a stirrup top (16), the stirrup top having an upper portion (18) to which a stirrup leather is attached, in use, and a pair of opposed side portions (22), the accessory dimensioned to be receivable within the stirrup opening (46) and including a receptacle (24) of a flexible material with a cover member (28) and a floor member (30) that defines a region (26) in which a boot or shoe of a rider is receivable, and at least one upper strap (32) and extends from the cover member to be engageable with the stirrup top, and at least one lower strap (34) or two side straps (52) that extend from the floor member for sides of the cover member respectively and engageable with the bottom or sides of the stirrup respectively, and a fastening arrangement (36) that is positioned on at least the straps to permit the straps and thus the receptacle to be releasably fastened to the stirrup iron, so that in use forward movement of the riders's boot, relative to the stirrup iron, is substantially checked, the fastening arrangement being adjustable so that the position of the receptacle relative to the stirrup iron can be adjusted, the straps being of sufficient length to go over the respected part of the stirrup to fasten to the receptacle, their adjustment resulting in adjustment of the toe position of the receptacle.

17 Claims, 4 Drawing Sheets

STIRRUPS

FIELD OF THE INVENTION

This invention relates to stirrups. More particularly, this invention relates to an accessory for a stirrup iron and to a stirrup assembly.

BACKGROUND TO THE INVENTION

It is well known that one of the biggest dangers facing horse riders is having a foot hooked in a stirrup iron when thrown or falling from a saddle. This can cause serious injuries or death as the rider is dragged along the ground and, possibly, struck with the horse's hooves or other obstacles.

It is also recognised that correct foot placement with respect to a stirrup is also very important both for the purposes of safety and in order to achieve the correct riding style. The correct foot placement is related to the position of a rider's heel with respect to a bottom of the stirrup. In particular, the rider's heel should be at least level with, if not lower than, the bottom of the stirrup.

A number of attempts have been made to address the problem of a foot being caught in the stirrup, when the rider is thrown or falls. One of these is disclosed in UK Patent No. 2 274 381 (Woodward). The device shown in this patent is essentially a pocket having a base portion and an upper portion, the pocket being connected to the stirrup. The pocket has flexible elements that fold about sides of a top of the stirrup and a bottom of the stirrup.

It is submitted that the flexible elements of Woodward do not provide a means whereby a toe portion of the pocket is prevented from moving downwardly. The Applicant therefore believes that the device of Woodward is not an effective measure against a rider's foot being caught in the stirrup. The Applicant believes further that the device of Woodward is not an effective measure for ensuring correct foot placement. One of the reasons for this is that Woodward does not disclose a significant adjustment mechanism whereby the position of the pocket can be adjusted relative to the stirrup. Applicant submits that it is important that the position of the pocket relative to the stirrup be adjustable so that differently sized boots or shoes can be accommodated in order to achieve a snug fit. The snug fit serves to ensure that a rider's boot or shoe does not move about within the pocket, disturbing the correct placement of the rider's foot with respect to the stirrup. The snug fit also serves to facilitate movement of the rider's boot or shoe out of the pocket, since the rider's foot is constantly maintained in the correct position.

A further patent, namely UK Patent No. 1 474 192 (Clark) shows an "adjustable safety toe stop". While, Clark. does disclose some level of adjustability, this adjustability is achieved by the provision of numerous openings providing incremental adjustment of the toe stop. Furthermore, the attachment of the device disclosed in Clark requires the provision of some form of connecting member received through these openings in a tread of the device.

Applicant respectfully submits that this form of incremental adjustment is not suitable for the provision of a level of adjustment required to achieve the snug fit mentioned above. Furthermore, the fact that further components are required to achieve the adjustability is both inconvenient and time consuming.

For the purposes of comfort and aesthetic appeal, it is important that the material of the device be resiliently flexible to accommodate a rider's boot or shoe. Clark does not disclose any particular form of material and applicant submits that aesthetic appeal is not an issue which is addressed by Clark.

Applicant submits further that Clark does not fully address the problem of a foot being caught in the stirrup. The reason for this is that Clark does not disclose a device which serves to shield the top portion of the stirrup from the rider's boot or shoe. It follows that the rider's boot or shoe can still be hooked up on the top portion of the stirrup in the event that the rider should fall from the saddle.

Other existing, published patents known to the applicant, for example UK Patent No. 2 216 384 (Hollingworth) and French Patent No. 2607488 (Marconier) do not disclose any form of adjustability. It would follow that the devices of these patents would have to be customised to suit the particular rider's boot or shoe size in order to function efficiently. Given the wide range of available boot and shoe sizes this would be excessively costly and inconvenient.

It follows that the applicant has identified that a significant problem exists with the prior art. This problem is based on, inter alia, the fact that the applicant is unaware of any accessories for stirrup irons that provide the level of adjustability required in order for the accessory to function effectively and safely.

SUMMARY OF THE INVENTION

According to a first aspect of the invention, there is provided an accessory for a stirrup iron having a stirrup bottom and a stirrup top, the stirrup top having an upper portion to which a stirrup leather is attached, in use, and a pair of opposed side portions, the accessory including

- a receptacle of a flexible material that defines a region in which a boot or shoe of a rider is receivable, the receptacle having a cover portion, a pair of opposed side portions and an opposed floor portion;
- at least one upper strap that extends from the cover portion to be engageable with the upper portion of the stirrup top;
- at least one lower strap that extends from the floor portion to be engageable with the stirrup bottom; and
- a fastening arrangement that is positioned on at least the straps to permit the straps and thus the receptacle to be releasably fastened to the stirrup iron, so that, in use, forward movement of the rider's boot or shoe, relative to the stirrup iron, is substantially checked, the fastening arrangement being adjustable so that the position of the receptacle relative to the stirrup iron can be adjusted.

The, or each, upper strap and the, or each, lower strap may be of sufficient length to be receivable over the upper portion of the stirrup stop and over the stirrup bottom, respectively, the fastening arrangement being in the form of complementary fastening mechanisms arranged on the straps and the receptacle, so that the straps are fastenable to the receptacle.

The, or each, upper strap may be configured so that adjustment of the fastening arrangement of the, or each, upper strap results in adjustment of a position of a toe portion of the receptacle relative to the stirrup iron.

The fastening mechanisms may be in the form of a length of one part of a hook-and-loop combination, known as VELCRO™, positioned on a side of the strap and a length of a complementary part of the VELCRO™ positioned on the receptacle.

An accessory as claimed in any one of the preceding claims, which includes a pair of spaced, upper straps, each upper strap being receivable over the upper portion of the stirrup top on respective sides of a stirrup leather opening defined in the upper portion, in use.

The receptacle may be dimensioned to be receivable within an opening of the stirrup iron, defined by the stirrup bottom and the stirrup top. The fastening arrangement may be configured so that a position of the receptacle relative to the stirrup iron can be adjusted with the receptacle received within the opening of the stirrup iron.

The material of the receptacle may be a synthetic, substantially water-impervious material. In particular, at least the floor member of the receptacle may be of a non-slip polyurethane material. A number of gripping formations may be arranged on the floor member to engage a sole of the rider's boot or shoe. The gripping formations may be of a suitable non-slip material such as rubber to inhibit slipping of the rider's boot or shoe in the receptacle, during normal use.

Furthermore, the cover member of the receptacle may be of an expanded material.

At least one ventilation opening may be defined in the receptacle.

The accessory may be in the form of a one-piece moulding.

According to a second aspect of the invention, there is provided an accessory for a stirrup iron having a stirrup bottom and a stirrup top, the stirrup top having an upper portion to which a stirrup leather is attached, in use, and a pair of opposed side portions, the accessory including a receptacle of a flexible material that defines a region in which a boot or shoe of a rider is receivable, the receptacle having a cover portion, a pair of opposed side portions and an opposed floor portion;

at least one upper strap that extends from the cover portion to be engageable with the upper portion of the stirrup top;

at least one pair of opposed side straps, a side strap of each pair extending from a respective side of the cover portion to be engageable with a respective side portion of the stirrup top; and a fastening arrangement that is positioned on at least the straps to permit the straps and thus the receptacle to be releasably fastened to the stirrup iron, so that, in use, forward movement of the rider's boot or shoe, relative to the stirrup iron, is substantially checked, the fastening arrangement being adjustable so that the position of the receptacle relative to the stirrup iron can be adjusted.

According to a third aspect of the invention, there is provided a stirrup assembly which includes a stirrup iron having a stirrup bottom and a stirrup top, the stirrup top having an upper portion to which a stirrup leather is attached, in use, and a pair of opposed side portions;

a receptacle of a flexible material that defines a region in which a boot or shoe of a rider is receivable, the receptacle having a cover portion, a pair of opposed side portions and an opposed floor portion;

at least one upper strap that extends from the cover portion and is engaged with the upper portion of the stirrup top;

at least one lower strap that extends from the floor portion and is engaged with the stirrup bottom, the straps serving to fasten the receptacle to the stirrup iron so that, in use, forward movement of the rider's boot or shoe, relative to the stirrup iron, is substantially checked; and an adjusting arrangement that is positioned on at least the straps to permit the straps and thus the receptacle to be adjusted relative to the stirrup iron.

A stirrup assembly which includes a stirrup iron having a stirrup bottom and a stirrup top, the stirrup top having an upper portion to which a stirrup leather is attached, in use, and a pair of opposed side portions;

a receptacle of a flexible material that defines a region in which a boot or shoe of a rider is receivable, the receptacle having a cover portion, a pair of opposed side portions and an opposed floor portion;

at least one upper strap that extends from the cover portion and is engaged with the upper portion of the stirrup top;

at least one pair of opposed side straps, a side strap of each pair extending from a respective side of the cover portion and engaged with a respective side portion of the stirrup top, the straps serving to fasten the receptacle to the stirrup iron so that, in use, forward movement of the rider's boot or shoe, relative to the stirrup iron, is substantially checked; and an adjusting arrangement that is positioned on at least the straps to permit the straps and thus the receptacle to be adjusted relative to the stirrup iron.

An accessory for a stirrup iron and a stirrup assembly, in accordance with this invention may manifest themselves in a variety of forms. Some preferred embodiments of the invention are set out below with reference to the accompanying drawings. The purpose of this specific description is to instruct persons having an interest in the subject matter .of the invention how to carry the invention into practical effect. It is to be clearly understood, however, that the specific nature of this description does not supersede the generality of the preceding broad description. In the drawings.

Figure 1:
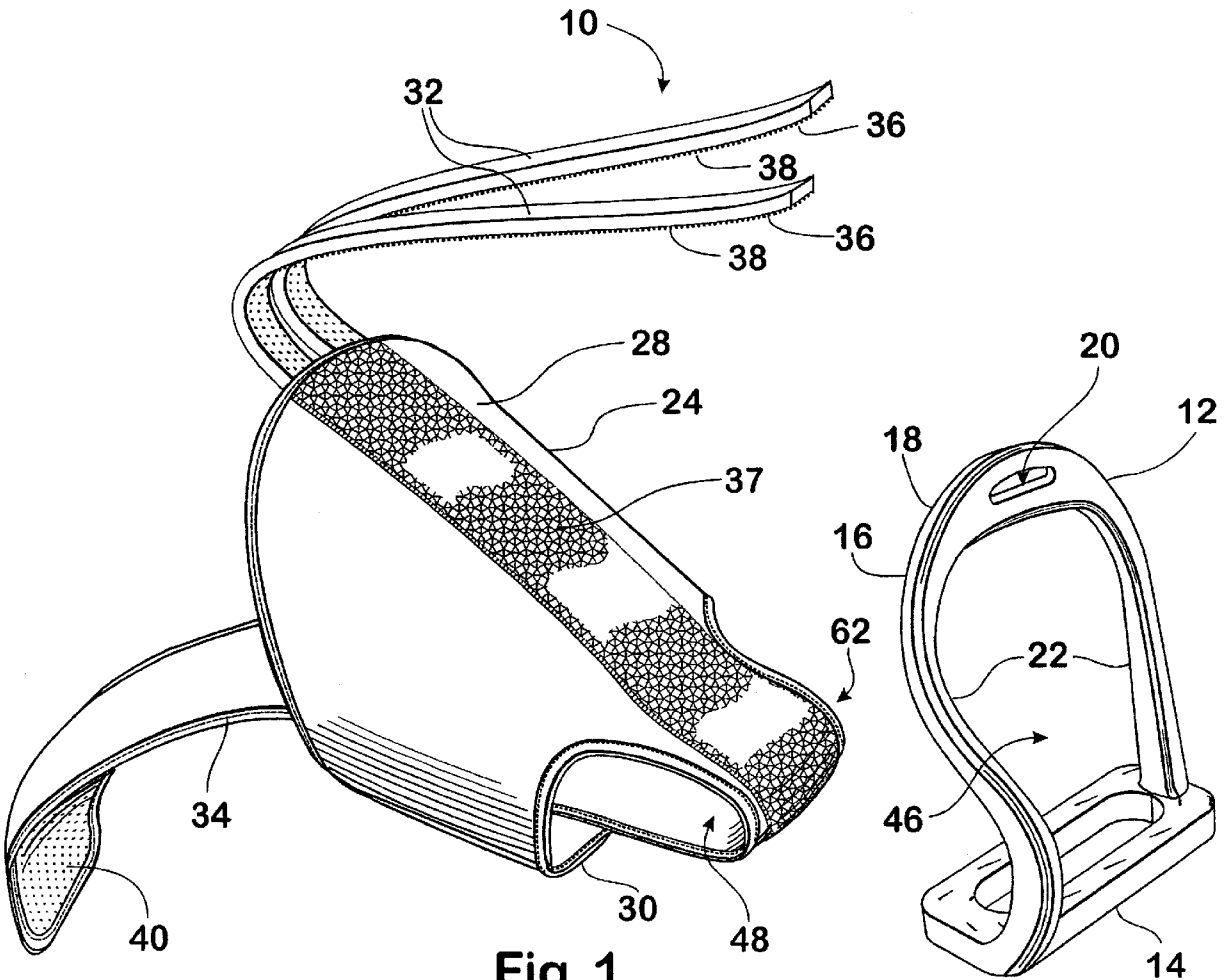
FIG. 1 shows a three dimensional view of a first embodiment of an accessory, in accordance with the invention, for a stirrup iron, in an inoperative condition prior to being fastened to a stirrup iron.
Figure 2:
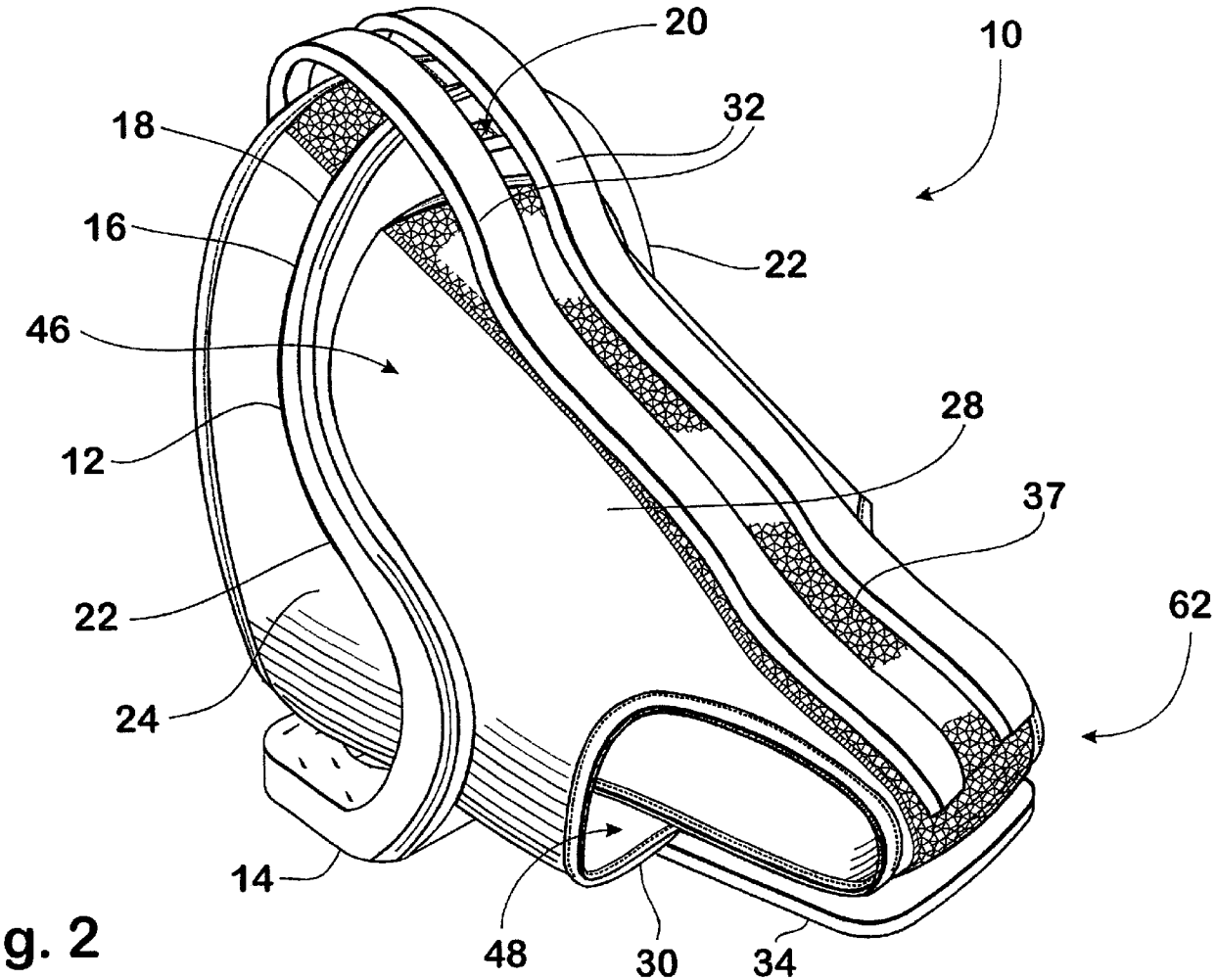
FIG. 2 shows the accessory of FIG. 1 fastened to the stirrup iron.
Figure 3:
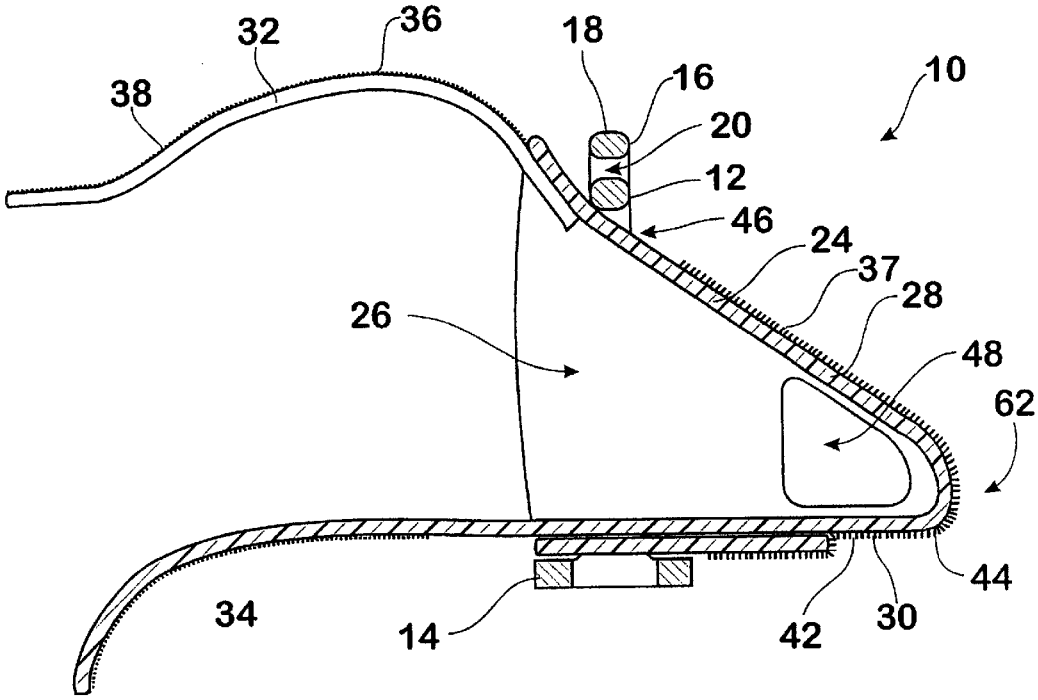
FIG. 3 shows a schematic, side-sectioned view of the accessory of FIG. 1 in a pre-fastened condition.
Figure 4:
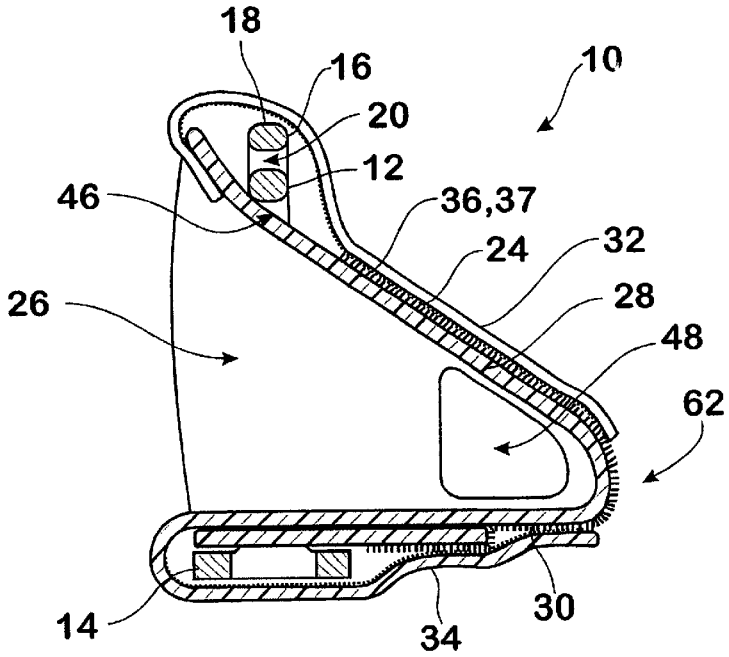
FIG. 4 shows a schematic, side-sectioned view of the accessory of FIG. 1 fastened to a stirrup.

In FIGS. 1 to 4, reference numeral 10 generally indicates an accessory, in accordance with the invention, for a stirrup iron 12.

The stirrup iron 12 is conventional in the sense that it has a stirrup bottom 14 and a stirrup top 16. However, it should not be inferred that the accessory of this invention is limited to use with only a conventional stirrup iron. It will readily be apparent that the accessory 10 can be used with any form of stirrup iron.

The stirrup top 16 has an upper portion 18 to which a stirrup leather (not shown) is attached via an opening 20 defined in the upper portion 18.

The stirrup top 16 further includes a pair of opposed side portions 22.

The accessory 10 includes a receptacle 24 which is of a flexible material and which defines a region 26 in which a boot or shoe (not shown) of a rider is received, in use. The receptacle 24 has a cover member or cover 28 and a floor member or floor 30. The receptacle 24 is of a flexible, synthetic material. Furthermore, the receptacle 24 is of a substantially water-impervious material. In this particular example, the material of the receptacle 24 is in the form of a non-slip polyurethane material. Still further, the material of the receptacle 24 is an expanded material suitable for absorbing impact. Thus, the polyurethane may be expanded into a suitable density.

The accessory 10 includes a pair of upper straps 32. The upper straps 32 extend from the cover 28. The accessory 10 also includes a lower strap 34 that extends from the floor 30.

Each of the upper straps 32 has a layer of one part 36 of a hook-and-eye combination known as VELCRO™ stitched to a side 38 of each upper strap 32. Another part 37'of the VELCRO™ is stitched to the cover 28.

Similarly, a layer of one part 40 of VELCRO™ is stitched to a side of the lower strap 34. Another part 42 of the VELCRO™ is stitched to a lower side 44 of the floor 30.

The upper straps 32 are of sufficient length to be received over the upper portion 18 of the stirrup top 16, on each side of the opening 20, to be releasably fastened to the cover 28 via the parts 36, 37 of VELCRO™. Further, the parts 36, 37 are of sufficient length to permit continuous adjustment of the upper straps 32 relative to the receptacle 24.

Similarly, the lower strap 34 is of sufficient length to be received over the stirrup bottom 14 and releasably fastened to the lower side 44 of the floor 30 via the parts 40, 42 of VELCRO™. The parts 40, 42 are of sufficient length to permit continuous adjustment of the lower strap 34 relative to the receptacle 24.

As can be seen in the drawings, the receptacle 24 is received within an opening 46 defined by the stirrup iron 12. Thus, further as can be seen in the drawings, the position of the receptacle 24 relative to the stirrup iron 12 can be adjusted from a position where the receptacle 24 is outside of the opening 46 to a position in which the receptacle 24 is, to a substantial degree, positioned within the opening 46

The receptacle 24 has a pair of apertures 48 defined therein. The apertures 48 serve to inhibit water from being retained within the receptacle 24. Further, the apertures 48 provide ventilation to the interior of the receptacle 24.

The floor 30 has a number of gripping formations or ridges 64 extending laterally across the floor 30. The ridges 64 are of a suitable non-slip material such as rubber. The ridges 64 are configured to inhibit excessive slipping of the rider's boot or shoe within the receptacle 24.

Figure 5:
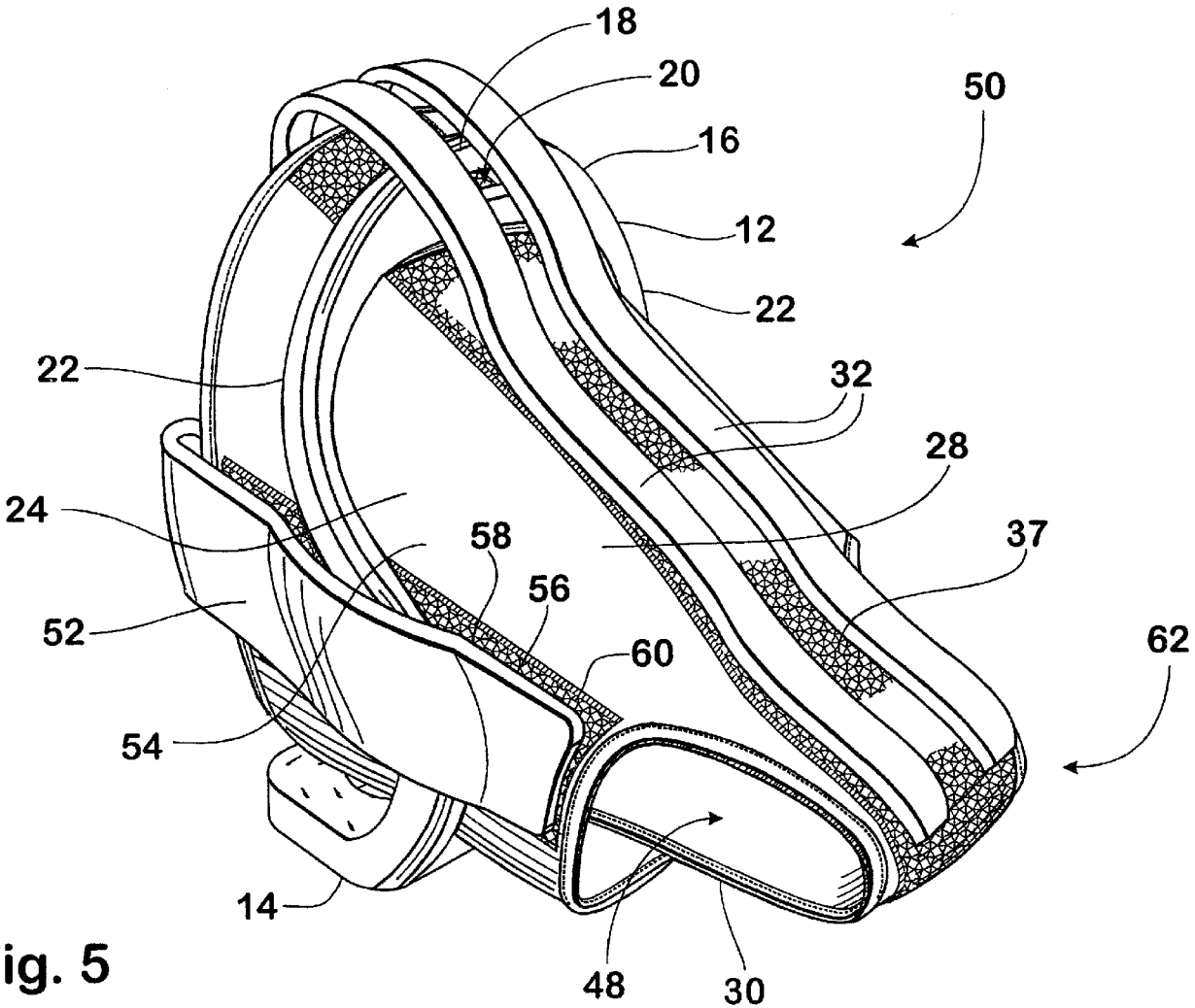
FIG. 5 shows a three dimensional view of a second embodiment of an accessory, in accordance with the invention, for a stirrup iron, fastened to a stirrup iron.

In FIG. 5, reference numeral 50 generally indicates a second embodiment of an accessory, in accordance with the invention, for a stirrup iron. With reference to FIGS. 1 to 4, like numerals refer to like parts, unless otherwise specified.

The accessory 50 is substantially identical to the accessory 10, with the exception that it includes a pair of side straps 52 instead of the lower strap 34. Each side strap 52 extends from a respective side 54 of the cover 28. As with the lower strap 34, a layer of one part 56 of VELCRO™ is stitched to a side 58 of each side strap 52 while a layer of another part 60 is stitched to each side 54 of the cover 28. The parts 56, 60 are positioned to correspond with each other when the receptacle 24 is in an operative condition.

With the accessory 50, the floor 30 is dimensioned so that the receptacle 24 can be moved to a position in which an upper side of the stirrup bottom 14 is exposed. This will allow riders to use boot inserts and the like with the stirrup iron 12.

In use, the adjustability of the accessory 10, 50 permits the accessory 10, 50 to be provided in only three sizes. These are small, medium and large size. The small size can be dimensioned to fit 3 to 3½ inch stirrup irons. The medium size can be dimensioned to fit 4 to 4½ inch stirrup irons. Further, the large size can be dimensioned to fit 4¾ to 5½ inch stirrup irons. The reason for this is the fact that the straps provide sufficient adjustment to suit a substantial range of boot and shoe sizes. Further, it is submitted that an accessory for a small sized stirrup iron can be used with a large sized stirrup iron. In particular, the small size accessory 10, 50 can be used with a 4½ inch stirrup, while the medium size accessory 10, 50 can be used with a 5½ inch stirrup. Thus, the accessory 10, 50 provides a means whereby it is not necessary to alter the stirrup when exchanging an adult rider for a child.

An important feature of the accessory 10, 50 is that the upper straps 32 can be used to retain a toe portion 62 of the receptacle 24 in a position in which a ball of a rider's foot is inhibited from moving downwardly past the stirrup bottom 14. Furthermore, the upper straps 32 can be used to position the ball of a rider's foot above the stirrup bottom 14. The straps 32 are particularly suitable for continuous adjustment of the ball of a rider's foot relative to the stirrup bottom 14. It follows that the accessory 10, 50 can be used to ensure that a rider's feet are suitably positioned for correct riding style. As is known by those who are involved in horse riding, it is good practice to keep the heels at a position lower than the stirrup bottom. The fact that the receptacle 24 can be adjusted in this manner, allows a rider's boot or shoe to be retained in the correct position. Furthermore, with the toe portion 64 adjusted upwardly, a rider's boot or shoe can easily move out of the receptacle 24 should the rider fall or be thrown from the horse.

Further, in connection With the material chosen for the receptacle 24, the material is such that the accessory 10, 50 does not weigh more than between approximately 60 and 100 grams. This allows the accessory 10, 50 to be used by jockeys without any sacrifice in weight.

The fact that the receptacle 24 is of a substantially water impervious material permits the accessory 10, 50 to be easily washed and cleaned. Furthermore, the material does not absorb water and subsequently increase in weight.

As set out earlier, the material is an expanded material. Thus, a rider's foot is protected from impact. This is particularly useful in the case of jockeys, since a jockey's feet can be prone to injury when the jockey leaves the starting gate.

A particularly important feature of the invention is that the receptacle 24 is received within the opening 46. This ensures that an upper surface of a rider's boot or shoe bears against the cover 28. This ensures that the boot or shoe is inhibited from becoming hung up on the stirrup top 16 and causing the rider's foot to be caught when the rider falls or is thrown from the horse.

It will of course be realised that the above has been given only by way of illustrative example of the invention and that all such modifications and variations thereto as would be apparent to persons skilled in the art are deemed to fall within the broad scope and ambit of the invention as is herein'set forth.

The claims defining the invention are as follows:

1. An accessory for a stirrup iron having a stirrup bottom and a stirrup top, the stirrup top having an upper portion to which a stirrup leather is attached, in use, and a pair of opposed side portions, the accessory including a receptacle of a flexible material that defines a region in which a boot or shoe of a rider is receivable, the receptacle having a cover portion, a pair of opposed side portions and an opposed floor portion;

at least one upper strap that extends from the cover portion to be engageable with the upper portion of the stirrup top;

at least one lower strap that extends from the floor portion to be engageable with the stirrup bottom; and a fastening arrangement that is positioned on at least the straps to permit the straps and thus the receptacle to be releasably fastened to the stirrup iron, so that, in use, forward movement of the rider's boot or shoe, relative to the stirrup iron, is substantially checked, the fastening arrangement being adjustable so that the position of the receptacle relative to the stirrup iron can be adjusted.

2. An accessory as claimed in claim 1, in which the, or each, upper strap and the, or each, lower strap are of sufficient length to be receivable over the upper portion of the stirrup top and over the stirrup bottom, respectively, the fastening arrangement being in the form of complementary fastening mechanisms arranged on the straps and the receptacle, so that the straps are fastenable to the receptacle.

3. An accessory as claimed in claim 2, in which the, or each, upper strap is configured so that adjustment of the fastening arrangement of the, or each, upper strap results in adjustment of a position of a toe portion of the receptacle relative to the stirrup iron.

4. An accessory as claimed in claim 3, in which the fastening mechanisms are in the form of a length of one part of a hook-and-eye combination, known as VELCRO (trade mark) positioned on a side of each strap and lengths of complementary parts of the hook-and-eye combination positioned on the receptacle.

5. An accessory as claimed in claim 1, which includes a pair of spaced, upper straps, each upper strap being receivable over the upper portion of the stirrup top on respective sides of a stirrup leather opening defined in the upper portion, in use.

6. An accessory as claimed in claim 1, which the receptacle is dimensioned to be receivable within an opening of the stirrup iron, defined by the stirrup bottom and the stirrup top.

7. An accessory as claimed in claim 6, in which the straps and the fastening arrangement are configured so that a position of the receptacle relative to the stirrup iron can be adjusted with the receptacle received within the opening of the stirrup iron.

8. An accessory as claimed in claim 1, in which the material of the receptacle is a synthetic, substantially water-impervious material.

9. An accessory as claimed in claim 8, in which at least the floor member of the receptacle is of a non-slip, polyurethane material.

10. An accessory as claimed in claim 8, in which at least the cover member of the receptacle is of an expanded material.

11. An accessory as claimed in claim 1 in which at least one ventilation opening is defined in the receptacle.

12. An accessory as claimed in claim 1 in which the receptacle and the straps are in the form of a one-piece moulding.

13. An accessory as claimed in claim 1 in which a plurality of gripping formations are arranged on the floor member, within the receptacle, to inhibit slipping of a rider's boot or shoe, in use.

14. An accessory for a stirrup iron having a stirrup bottom and a stirrup top, the stirrup top having an upper portion to which a stirrup leather is attached, in use, and a pair of opposed side portions, the accessory including a receptacle of a flexible material that defines a region in which a boot or shoe of a rider is receivable, the receptacle having a cover portion, a pair of opposed side portions and an opposed floor portion;

at least one upper strap that extends from the cover portion to be engageable with the upper portion of the stirrup top;

at least one pair of opposed side straps, a side strap of each pair extending from a respective side of the cover portion to be engageable with a respective side portion of the stirrup top; and a fastening arrangement that is positioned on at least the straps to permit the straps and thus the receptacle to be releasably fastened to the stirrup iron, so that, in use, forward movement of the rider's boot or shoe, relative to the stirrup iron, is substantially checked, the fastening arrangement being adjustable so that the position of the receptacle relative to the stirrup iron can be adjusted.

15. An accessory as claimed in claim 14, in which the, or each, upper strap and the, or each, side strap are of sufficient length to be receivable over the upper portion and side portions of the stirrup top, respectively, the fastening arrangement being in the form of complementary fastening mechanisms arranged on the straps and the receptacle, so that the straps are fastenable to the receptacle.

16. A stirrup assembly which includes a stirrup iron having a stirrup bottom and a stirrup top, the stirrup top having an upper portion to which a stirrup leather is attached, in use, and a pair of opposed side portions;

a receptacle of a flexible material that defines a region in which a boot or shoe of a rider is receivable, the receptacle having a cover portion, a pair of opposed side portions and an opposed floor portion;

at least one upper strap that extends from the cover portion and is engaged with the upper portion of the stirrup top;

at least one lower strap that extends from the floor portion and is engaged with the stirrup bottom, the straps serving to fasten the receptacle to the stirrup iron so that, in use, forward movement of the rider's boot or shoe, relative to the stirrup iron, is substantially checked; and an adjusting arrangement that is positioned on at least the straps to permit the straps and thus the receptacle to be adjusted relative to the stirrup iron.

17. A stirrup assembly which includes a stirrup iron having a stirrup bottom and a stirrup top, the stirrup top having an upper portion to which a stirrup leather is attached, in use, and a pair of opposed side portions;

a receptacle of a flexible material that defines a region in which a boot or shoe of a rider is receivable, the receptacle having a cover portion, a pair of opposed side portions and an opposed floor portion;

at least one upper strap that extends from the cover portion and is engaged with the upper portion of the stirrup top;

at least one pair of opposed side straps, a side strap of each pair extending from a respective side of the cover portion and engaged with a respective side portion of the stirrup top, the straps serving to fasten the receptacle to the stirrup iron so that, in use, forward movement of the rider's boot or shoe, relative to the stirrup iron, is substantially checked; and an adjusting arrangement that is positioned on at least the straps to permit the straps and thus the receptacle to be adjusted relative to the stirrup iron.

* * * * *

UNITED STATES PATENT AND TRADEMARK OFFICE

CERTIFICATE OF CORRECTION

PATENT NO. : 6,513,309 B1
DATED : February 4, 2003
INVENTOR(S) : Adrian Anthony Morgante It is certified that error appears in the above-identified patent and that said Letters Patent is hereby corrected as shown below:

Title page,
Item [57], ABSTRACT,
Line 9, "and extends" should read -- that extends --
Line 12, "for" should read -- or --
Line 21, "respected" should read -- respective --

Column 1,
Line 50, delete commas (,) from "while, Clark,"

Column 4,
Line 23, delete period (.) from ".of"

Column 5,
Line 3, delete apostrophe (') from "37"
Line 24, insert period (.) after "opening 46"

Column 6,
Line 41, delete apostrophe (') after "herein"

Column 8,
Line 3, "substartially" should read -- substantially --

Signed and Sealed this

Eighth Day of July, 2003

JAMES E. ROGAN
*Director of the United States Patent and Trademark Office*